United States Patent [19]

Thorsen

[11] 4,189,303

[45] Feb. 19, 1980

[54] METHOD OF SHRINKPROOFING ANIMAL FIBERS WITH OZONE

[75] Inventor: Walter J. Thorsen, El Cerrito, Calif.

[73] Assignee: The United States of America as represented by the Secretary of Agriculture, Washington, D.C.

[21] Appl. No.: 904,646

[22] Filed: May 10, 1978

[51] Int. Cl.[2] ..... D06M 3/08; D06M 9/08

[52] U.S. Cl. ..... 8/115.7; 8/127.51; 8/128 R

[58] Field of Search ..... 8/127.5, 128 R, 127.51, 8/115.7

[56] References Cited

U.S. PATENT DOCUMENTS

| | | | |
|---|---|---|---|
| 1,934,956 | 11/1933 | Wait | 8/53 |
| 3,149,906 | 9/1964 | Thorsen | 8/127.5 |

FOREIGN PATENT DOCUMENTS

| | | | |
|---|---|---|---|
| 317133 | 8/1929 | United Kingdom | 8/128 R |

OTHER PUBLICATIONS

Chem. Abstracts, vol. 84: 61019u, 1976, vol. 48: 12414i, 1954, vol. 68: 40963b, 1968.

*Primary Examiner*—Donald E. Czaja
*Assistant Examiner*—Maria S. Tungol
*Attorney, Agent, or Firm*—M. Howard Silverstein; David G. McConnell; Theodore J. Leitereg

[57] ABSTRACT

Proteinaceous animal fibrous materials are shrinkproofed by contacting the material with an aqueous solution of ozone at a temperature of about 0° to 50° C. for a period of time and at a concentration sufficient to shrinkproof the material but insufficient to cause degradation of the material.

6 Claims, No Drawings

METHOD OF SHRINKPROOFING ANIMAL FIBERS WITH OZONE

BACKGROUND OF THE INVENTION

1. Field of the Invention

This invention relates to and has among its objects the provision of a novel process and apparatus for shrinkproofing proteinous animal fibers, e.g., wool, mohair, and the like, or blends of these fibers with non-proteinous animal fibers such as cotton, polyester, acrylic, etc. Further objects of the invention will be evident from the following description wherein parts and percentages are by weight unless otherwise specified.

2. Description of the Prior Art

As a general proposition, the treatment of wool with ozone has been described heretofore and has been suggested as a means of improving the shrinkage properties of the textile. Various investigators have explored the situation and have advocated different techniques for accomplishing their desired ends. A typical procedure is that described in British Pat. No. 242,027, Nov. 5, 1925. In this process wool is soaked in 5% ammonia solution for a few minutes, hydro-extracted (centrifuged) to remove excess liquid, and then placed while damp in a chamber werein it is exposed to air containing ozone in a concentration of about one part per 1000. The process is exceedingly slow as evidenced by the fact that the patentees suggest removing samples of wool "at intervals of a few hours" to test them for acidity. (If acid, the wool is again soaked in ammonia solution prior to further ozone treatment.) The procedure of the British patent, termed the "Zair" process, was further investigated by Brown (Journal of the Society of Dyers and Colourists, Vol. 44, pp. 230–233, 1928) who illustrates the long duration of the process, i.e., 5 to 20 hours. In addition to requiring long processing times, the various prior procedures have involved such disadvantages as erratic and non-uniform results, decrease in abrasion resistance of the treated wool, and even loss of material during processing by dissolving of a portion of the fibers. As a net result, the ozone treatment of wool has not met with commercial acceptance.

More recently, the present inventor, Walter J. Thorsen, has shown in U.S. Pat. No. 3,149,906 ('906) that much faster shrinkproofing of wool is obtained where a stream of ozone and steam is blown through the textile under treatment. For example, it is shown in this patent that wool can be rendered shrinkproof in a processing time of 1 to 10 minutes. The steam-ozone mixture has an ozone content of about 10–50 milligrams/liter (mg/l). The temperature at which the patented process is carried out is about 60°–95° C. Generally, the ozone is produced in a conventional device wherein oxygen (or air) is passed through an electrical system involving a high-voltage silent discharge. The effluent gas from this device contains, for example, about from 10 to 100 mg/l of ozone, depending on the circuit adjustments of the device. The portion of this gas stream which is not ozone is, of course, oxygen (or air). This gas stream is mixed with a stream of steam produced by a conventional steam generator.

The '906 process is disadvantageous for the reason that machinery for conducting the process does not exist. Thus, the fiber processor necessarily would be required to expend a considerable amount of money to initiate the above invention. Further disadvantages are that ozone utilization is inefficient and shrinkproofing of sliver is impossible.

In U.S. Pat. No. 3,404,942 ('942) another method of shrinkproofing wool with ozone is disclosed. Heat is applied to one side of a proteinaceous fabric at a temperature in the range of 80°–170° C. Concomitantly, a gas stream containing ozone is passed over the opposite side of the fabric. The path of the ozone gas stream is confined adjacent and parallel to this side.

The '942 method requires a preliminary prewetting step (dip and pad stage). A further disadvantage is that during treatment dry ozone-laden air (or oxygen) passed over the dampened fabric causes a drying of this material. Extended treatment times result in a completely dried fabric and the reaction terminates, resulting in a waste of energy and time.

SUMMARY OF THE INVENTION

I have discovered a new method which overcomes the disadvantages of the known methods. The instant process may be practiced using conventional equipment with only minor modification so that the processor is not required to make a large expenditure of time and money in installing new equipment. The process is adaptable to existing continuous processing machinery.

All types of fiber assemblies may be treated by my process including woven or knitted fabrics, garments, yarns, top, or loose fibers. The problem of drying out of dampened fibers encountered in previous methods cannot occur in the process of the invention.

The benefits of my process are obtained by contacting a material of proteinaceous animal fibers or a blend of such fibers with non-proteinaceous fibers such as polyester, cotton, rayon, acrylic, etc., with an aqueous solution of ozone at a temperature of about 0°–50° C. and for a period of time and at a concentration sufficient to impart shrinkproofing properties to the material but insufficient to degrade the material.

A primary advantage of the invention is that the treatment is carried out at low temperatures, i.e., 0°–50°0 C., as compared to known methods which require temperatures of about 60°–170° C. Preferably, the instant process is conducted at ambient temperature. As a result, considerable savings accrue because energy is conserved.

Another advantage of the invention is that the process is carried out at neutral pH, thus, minimizing fiber degradation. In fact, fabrics treated in accordance with my process exhibit no significant loss of their mechanical properties, such as tensile strength, abrasion resistance, etc. In addition, the material retains its original hand so that it is suitable for fabrication of garments of all kinds such as suits, skirts, shirts, and so forth.

A further advantage of the invention is that treated fibers are whiter than untreated fibers. Furthermore, the treated fibers take up dyes more rapidly than untreated ones. The fastness of dyes to ozone-treated wool is unchanged.

The treated product displays increased fiber cohesive forces; that is, the individual fibers cling to one another more tenaciously than is the case with the untreated material. This in turn provides these benefits: Yarns can be spun to a higher count, that is, to finer diameter or fewer fibers per cross-section. Yarns can be fabricated with less twist than from the untreated fibers, yet without any loss in yarn tensile strength. (Yarns with less twist are especially desirable for fabricating garments as the products have improved wrinkle recovery.) Finer yarns can be spun from the treated fibers and with greater efficiency, e.g., with fewer breaks.

The success of my process is quite surprising and unexpected. The teaching of the art requires the use of high temperatures, e.g., 60°-170° C. when shrinkproofing wool with ozone. However, in the present invention excellent shrinkproofing of fabrics with ozone is obtained at temperatures of about 0°-50° C. in a matter of minutes, usually 2-6 minutes. This short period of treatment is equivalent to that of the '906 process wherein temperatures of about 60°-95° C. are employed. Of course, the '906 process and the present process also differ in that a stream of steam and an ozone-air (or oxygen) stream are simultaneously impinged upon the fabric in the former method whereas in the latter method the fabric is contacted with an aqueous ozone solution.

DESCRIPTION OF THE PREFERRED EMBODIMENTS

As indicated above, in the process of my invention fabrics of proteinaceous fibers are contacted with an aqueous solution of ozone at a temperature of about 0°-50° C., preferably about 20°-30° C., in a concentration and for a period of time sufficient to impart shrinkproofing to the fabric. Generally, the concentration of ozone in water is about 1-20 mg/l, with a preferred range of 10-15 mg/l. To attain this concentration ozone is dispersed into water according to conventional techniques; then aliquots are taken and analyzed for ozone content. Dispersion of the ozone into the water is continued until the desired concentration is reached. It is to be noted that at higher temperatures, e.g., 40°-50° C., less ozone will dissolve in water.

The time of contact between the fibrous material and the aqueous ozone solution is dependent on the reaction temperature, the concentration of ozone, the type of fibrous material being treated, and the degree of modification of the fibrous material that is desired. For example, an increase in reaction temperature or an increase in ozone concentration will increase the speed of modification. In any particular case, pilot trials may be conducted with the material to be treated, employing various conditions and testing the properties of the product. From such tests the appropriate conditions may be easily derived. In such trials, the shrinkage characteristics of the product may, for example, be used as the criterion and the conditions of reaction selected so that the area shrinkage of the product (tested by a standard method) is markedly improved, i.e., reduced to at least one-half, preferably at least one-tenth, of that displayed by the starting (untreated) material. It is, of course, obvious that the process should not be continued for a period long enough to cause degradation of the fibers. As noted above, the process of the invention is rapid so that effective results are obtained in a matter of minutes, for example, 2 to 6 minutes; and in no case is the time of reaction more than 10 minutes.

Following the treatment with the steam-ozone mixture, the treated material may be acidified, for example, by dipping it into a bath of dilute hydrochloric or sulphuric acid. Typically, this step is accomplished by immersing the material in 0.1 N HCl for 1 to 3 minutes. This acidification acts to restore softness of hand to the treated material and to restore its original resistance to abrasion. The acidification procedure is, however, optional and need not be applied if subsequent dyeing is planned, as the acid or salt used in the dyebath accomplishes the same purpose.

The process of the invention is applicable to animal fibrous materials such as wool and mohair or blends of these fibers with any other type of fiber. These materials may be in any of various physical forms, e.g., bulk fibers, slivers, roving, top, yarns, felts, woven textiles, knitted textiles, or even garments or garment parts.

It is desirable, though not required, to prewet the material to be treated prior to its contact with the aqueous ozone solution. For this purpose conventional wetting agents such as Igepal CO-710 (non-ionic), Atcowet T-25 (anionic), etc., may be employed. Generally, the amount of wetting agent used is about 0.05 to 0.1 parts per 100 parts of wetting bath. Generally, the rate and uniformity of shrinkresisting is enhanced by this prewetting step.

Various conventional types of textile-treating devices can be adapted to achieve the desired contact between the material and the aqueous ozone solution. Basically, ozone-enriched water is prepared in an absorption tank, then pumped into a treating tank wherein it contacts the fabric or top to be shrinkproofed, and then the ozone-depleted liquid is returned to the absorption tank where it is replenished. Preferably, the aqueous solution of ozone is circulated by force through the fabric. The treatment water is removed from the tank and replenished with ozone at appropriate intervals to maintain the desired ozone concentration therein. The method can be used to treat fibrous materials in batch-wise or continuous operations (i.e. the materials under treatment may be continuously drawn through the treating tank and the treatment water continuously removed and replenished with ozone).

EXAMPLES

The invention is demonstrated further by the following illustrative examples.

In some experiments coarse wool top—33.3 gms/m (12.7 gms/tex), 54's grade, 7.4 cm staple length wool—was used. In other experiments two types of fabric were employed: (a) woolen, 2/1 twill, 7.0 ox/yd$^2$; and (b) knitted, plain jersey, 15.0 courses/in, 8.5 wales/in, 8.5's (worsted count) yarn.

Wash tests

For fabric each sample was washed 15 minutes at 41° C. with regular agitation in a top-loading domestic washer and then tumble-dried for 30 minutes according to AATCC Method 124-1973. The above procedure was repeated ten times. An area shrinkage of 5% or less was considered an indication of good shrink-resistance.

Treated top was first reduced on a pin drafter from 33.3 to 17.7 gms/m. Then, shrinkage was determined by a method similar to that described by Bogarty et al. in *Textile Res. J.*, Vol. 20, pages 270-276 (1950). A length shrinkage of 15% or less after three washes was considered to be a good indication that fabric knitted from treated top would be shrink-resistant.

EXAMPLE 1

Treatment of Wool Top

Coarse wool top (28.5 g) was placed in a 25 cm diameter Buchner funnel and secured by a stainless steel screen. An aqueous solution of ozone containing 10.0 mg/l of ozone was passed into the funnel in the back flow direction at a rate of 31.1 l/min and a temperature of 27° C. After 4 minutes the sample was removed and its shrink-resistance was determined.

The above procedure was repeated at different temperatures and flow rates. Furthermore, a control was run wherein ozone was omitted from the water. The results are tabularized below.

| Treatment | | | | Shrinkage |
|---|---|---|---|---|
| Ozone conc. (mg/l) | Temp. (°C.) | Flow rate (l/min) | Time (min) | in length (%) |
| 10.0 | 27 | 31.1 | 4.0 | 9.0 |
| 9.0 | 27–28 | 24.3 | 4.0 | 12.8 |
| 14.0 | 18 | 34.0 | 4.0 | 13.0 |
| None | 27 | 31.1 | 4.0 | 44.0* |

*After two washes.

EXAMPLE 2

Treatment of Woolen Fabric

A 30-g sample (35.6×35.6 cm) of woolen twill fabric was secured to the top of a 25 cm Buchner funnel. An aqueous solution (11 mg/l) of ozone was passed into the funnel in the back flow direction at a rate of 32.4 l/min and a temperature of 22° C. for a period of 4.75 min. The so-treated sample was tested for shrink-resistance.

The procedure described above was repeated with the following changes: Another sample of fabric was prewetted with a 0.05% aqueous solution of non-ionic detergent (Igepal CO-710, alkylphenoxypoly(ethylenoxy)ethanol, manufactured by General Analine and Film Corp., New York, New York) prior to being attached to the funnel. The fabric was then treated with aqueous ozone for 5 minutes at a flow rate of 7.5 l/min.

The above procedure was repeated varying the flow rate, temperature, and time of treatment. The results are summarized below. Untreated controls were also run.

| Treatment | | | | | Area |
|---|---|---|---|---|---|
| Pre-wetting | Ozone conc. (mg/l) | Temp. (°C.) | Flow rate (l/min) | Time (min) | shrinkage (%) |
| No | 11 | 22 | 32.4 | 4.75 | 12.1 |
| Yes | 11 | 22 | 7.5 | 5.0 | 0 |
| Yes | 11 | 22 | 35.1 | 3.25 | 4.5 |
| Yes | 7.5 | 32 | 35.0 | 3.25 | 1.5 |
| Yes | None | 22 | | 3.25 | 45.2 |

-continued

| Treatment | | | | | Area |
|---|---|---|---|---|---|
| Pre-wetting | Ozone conc. (mg/l) | Temp. (°C.) | Flow rate (l/min) | Time (min) | shrinkage (%) |
| | (control) | | | | |

EXAMPLE 3

Treatment of Knitted Fabric

A piece of knitted fabric was secured over a 25 cm Buchner funnel and treated with an aqueous solution of ozone (11.0 mg/l) at 22° C., flow rate 32.4 l/min for a period of 5 minutes. Then, the shrink-resistance of the so-treated fabric was determined. An untreated control was also run. The following results were obtained.

| Treatment | | | | Area |
|---|---|---|---|---|
| Ozone conc. (mg/l) | Temp. (°C.) | Flow rate (l/min) | Time (min) | shrinkage (%) |
| 11 | 22 | 32.4 | 5.0 | +2.5* |
| None (control) | 22 | 32.4 | 5.0 | 48.3 |

*A plus (+) sign indicates that the fabric actually expanded, rather than shrank.

Having thus described my invention, I claim:

1. A process for shrinkproofing proteinaceous animal fibrous materials, which consists of —

(a) preparing an aqueous solution of ozone containing about 1 to 20 milligrams of ozone per liter of solution and (b) contacting the so-prepared solution with the material at neutral pH at a temperature of about 20°–30° C. for a period of about 2–6 minutes.

2. The process of claim 1 wherein the proteinaceous animal fibrous material is contacted with a wetting agent prior to its contact with the aqueous ozone solution.

3. The process of claim 1 wherein the proteinaceous animal fibrous material is wool.

4. The process of claim 1 wherein the proteinaceous animal fibrous material is mohair.

5. The process of claim 1 wherein the proteinaceous animal fibrous material is a blend of proteinaceous animal fibers and non-proteinaceous fibers.

6. The process of claim 1 wherein the material is contacted with an aqueous ozone solution containing about 10 to 15 milligrams of ozone per liter of solution at a temperature of about 20° to 30° C. for a period of 2–6 minutes.

* * * * *